US010233061B2

(12) United States Patent
Averill et al.

(10) Patent No.: US 10,233,061 B2
(45) **Date of Patent: *Mar. 19, 2019**

(54) REMOTE WINCH CLUTCH SYSTEM

(71) Applicant: Warn Industries, Inc., Clackamas, OR (US)

(72) Inventors: Bryan M. Averill, Portland, OR (US); Oliver Heravi, Beaverton, OR (US); Jeff Walston, Gig Harbor, WA (US); Garrett F. Pauwels, Beaverton, OR (US); Kevin M. Christensen, Portland, OR (US)

(73) Assignee: Warn Industries, Inc., Clackamas, OR (US)

( * ) Notice: Subject to any disclaimer, the term of this patent is extended or adjusted under 35 U.S.C. 154(b) by 346 days.

This patent is subject to a terminal disclaimer.

(21) Appl. No.: 15/058,030

(22) Filed: Mar. 1, 2016

(65) Prior Publication Data

US 2016/0176687 A1 Jun. 23, 2016

Related U.S. Application Data

(63) Continuation of application No. 13/790,807, filed on Mar. 8, 2013, now Pat. No. 9,315,364.

(51) Int. Cl.
*B66D 1/16* (2006.01)
*B66D 1/40* (2006.01)
(Continued)

(52) U.S. Cl.
CPC ..... *B66D 1/16* (2013.01); *B66D 1/12* (2013.01); *B66D 1/22* (2013.01); *B66D 1/40* (2013.01); *B66D 1/56* (2013.01)

(58) Field of Classification Search
CPC ... B66D 1/12; B66D 1/16; B66D 1/22; B66D 1/40; B66D 1/56
See application file for complete search history.

(56) References Cited

U.S. PATENT DOCUMENTS 2,104,647 A 1/1938 Henry, Jr.
2,552,859 A 5/1951 Nardone
(Continued)

FOREIGN PATENT DOCUMENTS

CN 200995938 Y 12/2007
CN 101190770 A 6/2008
(Continued)

OTHER PUBLICATIONS

"Installation Instructions P & Q 600 Series Dual Coil '3 Wire' DC Solenoids," Trombetta Corporation, X190 (H10558), Revision Aug. 23, 2007, 2 pages.
(Continued)

*Primary Examiner* — Michael E Gallion
(74) *Attorney, Agent, or Firm* — K&L Gates LLP

(57) ABSTRACT

A winch is provided including a rotatable drum and a gear train drivingly connecting a motor to the rotatable drum. The gear train includes a clutch that is operable to be disengaged to allow the rotatable drum to free spool. A clutch actuator is provided for disengaging the clutch and the clutch includes a pivoting pawl having a first end that engages a clutch dog of a planetary ring gear and the clutch actuator includes an electro-magnetic solenoid having a plunger that engages a second end of the pivoting pawl.

17 Claims, 6 Drawing Sheets

(51) Int. Cl.

| | |
|---|---|
| ***B66D 1/56*** | (2006.01) |
| ***B66D 1/22*** | (2006.01) |
| ***B66D 1/12*** | (2006.01) |

(56) References Cited

U.S. PATENT DOCUMENTS

| | | | | |
|---|---|---|---|---|
| 3,069,140 | A * | 12/1962 | Blair | B66D 1/36 200/61.15 |
| 3,114,346 | A | 12/1963 | Dahlin | |
| 3,280,946 | A | 10/1966 | Guibeaud | |
| 3,301,533 | A | 1/1967 | Pfaff, Jr. et al. | |
| 3,719,348 | A | 3/1973 | Wells | |
| 3,732,570 | A | 5/1973 | Fiorentino | |
| 3,834,670 | A * | 9/1974 | Pityo | B66D 1/16 114/210 |
| 3,985,047 | A | 10/1976 | Therkelsen | |
| 4,475,743 | A | 10/1984 | Wittmann | |
| 4,486,007 | A | 12/1984 | Kuhlman | |
| 4,545,567 | A | 10/1985 | Telford et al. | |
| 4,809,857 | A * | 3/1989 | Steuck | B66D 1/40 212/276 |
| 5,123,630 | A | 6/1992 | Watson et al. | |
| 5,692,735 | A * | 12/1997 | Aho | B66D 1/00 254/323 |
| 5,791,576 | A | 8/1998 | Miyazaki | |
| 5,842,684 | A * | 12/1998 | Aho | B66D 1/08 254/344 |
| 5,860,635 | A | 1/1999 | Moffitt et al. | |
| 5,927,691 | A | 7/1999 | Ottemann | |
| 6,046,893 | A * | 4/2000 | Heravi | H02H 7/085 318/434 |
| 6,474,588 | B2 | 11/2002 | Valverde | |
| 6,604,731 | B2 | 8/2003 | Hodge | |
| 6,864,650 | B2 * | 3/2005 | Heravi | B60P 3/12 318/266 |
| 6,995,682 | B1 | 2/2006 | Chen et al. | |
| 7,891,641 | B1 | 2/2011 | Miller | |
| 7,984,894 | B1 * | 7/2011 | Chauza | B66D 1/16 254/344 |
| 8,434,742 | B2 | 5/2013 | Akhavein et al. | |
| 8,968,140 | B1 * | 3/2015 | Wilburn, Jr. | B66D 5/02 475/156 |
| 9,266,702 | B2 * | 2/2016 | Fretz | B66D 1/02 |
| 9,315,364 | B2 * | 4/2016 | Averill | B66D 1/12 |
| 2002/0005451 | A1 | 1/2002 | Valverde | |
| 2002/0007691 | A1 | 1/2002 | Peter | |
| 2006/0097236 | A1 | 5/2006 | Copeman | |
| 2007/0221898 | A1 | 9/2007 | Giacomini et al. | |
| 2008/0116430 | A1 | 5/2008 | Elliott et al. | |
| 2008/0302289 | A1 | 12/2008 | Mann | |
| 2010/0065799 | A1 | 3/2010 | Zhou et al. | |
| 2011/0258998 | A1 | 10/2011 | Straume et al. | |
| 2012/0068133 | A1 | 3/2012 | Ozarski | |
| 2012/0068477 | A1 | 3/2012 | Bradfield | |
| 2012/0080652 | A1 | 4/2012 | Mann | |
| 2012/0215393 | A1 * | 8/2012 | Schiedegger | B60P 3/11 701/23 |
| 2014/0084229 | A1 * | 3/2014 | Morrison | B66D 1/00 254/344 |

FOREIGN PATENT DOCUMENTS

| | | |
|---|---|---|
| GB | 537266 | 6/1941 |
| GB | 723045 | 2/1955 |
| JP | 2001199687 A | 7/2001 |

OTHER PUBLICATIONS

"P600 Solenoid Family," Trombetta Motion Technologies Website, Available at https://web.archive.org/web/20121219090549/http://www.trombetta.com/solenoids-products.cfm?id=14, Edition Available on Dec. 19, 2012, 1 page.

"P613 Series Abbreviated Specifications & Dimensions W-P613-18001," Trombetta Motion Technologies, Revision A, ECN3599, Aug. 13, 2013, 1 page.

ISA United States Patent and Trademark Office, International Search Report and Written Opinion Issued in Application No. PCT/US14/11208, dated Jul. 21, 2014, WIPO, 14 pages.

* cited by examiner

REMOTE WINCH CLUTCH SYSTEM

CROSS REFERENCE RELATED APPLICATIONS

The present application is a continuation of U.S. patent application Ser. No. 13/790,807, entitled "Remote Winch Clutch System," filed on Mar. 8, 2013, the entire contents of which are hereby incorporated by reference for all purposes.

FIELD

The present disclosure relates to winches and more particularly, to a remote controlled clutch system for a winch.

BACKGROUND

This section provides background information related to the present disclosure which is not necessarily prior art.

Winches are commonly used for off-road vehicles and in farm, ranch, and other industrial applications where an operator is using the rope or cable to connect to various structures. In order to quickly spool-out the rope or cable from a winch, winches are commonly provided with a free-spool operation mode which is typically operated by a manual shift lever on the winch gear case that disengages a clutch device from a component of the planetary gear system of the winch. Often times, the winch cable is connected to the various structures at a distance from the winch and the operator is required to walk back and forth to the winch for disengaging and re-engaging the clutch. Accordingly, it is desirable to provide a remote actuated clutch for a winch to allow the operator to disengage and re-engage the winch clutch from a remote location.

SUMMARY

This section provides a general summary of the disclosure, and is not a comprehensive disclosure of its full scope or all of its features.

According to an aspect of the present disclosure, a winch is provided including a rotatable drum and a gear train drivably connecting a motor to the rotatable drum. The gear train includes a clutch that is operable to be disengaged to allow the rotatable drum to free spool. A clutch actuator is provided for disengaging the clutch and the clutch includes a pivoting pawl having a first end that engages a clutch dog of a planetary ring gear and the clutch actuator includes an electro-magnetic solenoid having a plunger that engages a second end of the pivoting pawl.

According to a further aspect of the present disclosure, the electro-magnetic solenoid includes a first coil and a second coil, the first coil being operated along with the second coil to retract the plunger and the plunger being held in the retracted position by only the first coil.

According to another aspect, a limit switch is provided that is tripped by one of the plunger and the pivoting pawl when the plunger and pivoting pawl are in a disengaged position. The limit switch is in communication with a controller to indicate that the clutch is in a disengaged position to allow the rotatable drum to free spool.

According to a still further aspect of the present disclosure, the pivoting pawl includes a pawl head at the first end with an angled face. The pivoting pawl is pivoted about a pivot pin that is held in a pair of pockets by a spring member that deflects when the rotatable drum is under load and the pivoting pawl is engaged with the clutch dog, allowing the pivoting pawl to move laterally. A pawl stop is positioned with a small gap to the pawl head. When the pawl head moves laterally against the spring member, the gap is closed and the pawl head rests against the pawl stop. The pawl stop and the pawl head have slightly angled opposing faces which impact a radial force on the pivoting pawl to hold it in the engaged position.

Further areas of applicability will become apparent from the description provided herein. The description and specific examples in this summary are intended for purposes of illustration only and are not intended to limit the scope of the present disclosure.

DRAWING

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
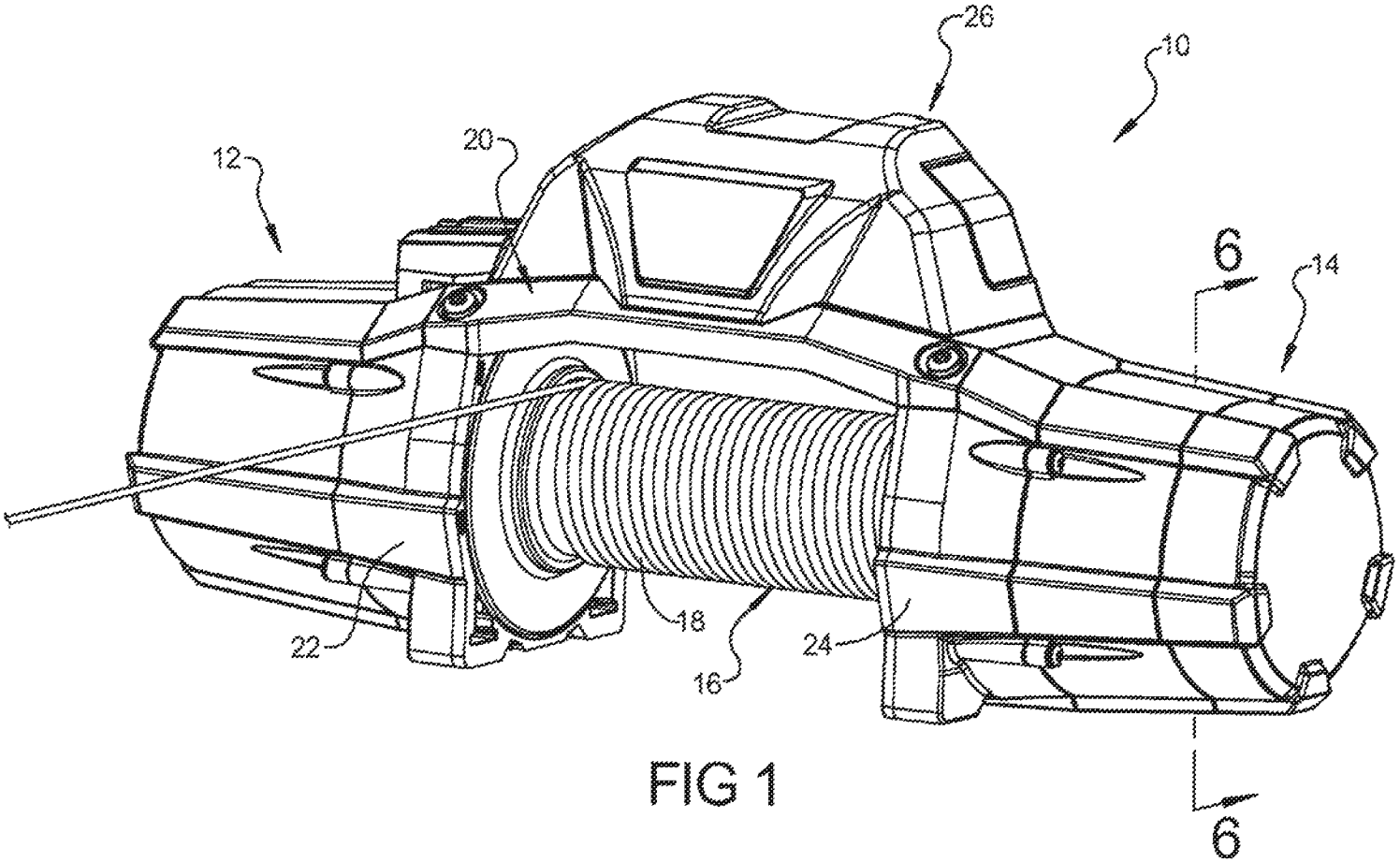
FIG. 1 is a perspective view of a winch according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specific the presence of stated features, integers, steps, operations, elements, and/or components, but do not preclude the presence or additional of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a wince 10 according to the principles of the present disclosure will now be described. The winch 10 includes a motor assembly 12 drivingly connected to a gear reduction unit 14 which provides driving torque to a rotatable drum 16. A cable 18 can be wound onto, or off from, the rotatable drum 16 to provide various pulling operations. A tie plate 20 can be disposed for connection between a first drum support 22 of the motor assembly 12 and a second drum support 24 of the gear reduction unit 14. A control unit 26 can be removably mounted to the tie plate 20. The first drum support 22 and the second drum support 24 provide a bearing support structure for rotatably supporting the rotatable drum 16.

Figure 2:
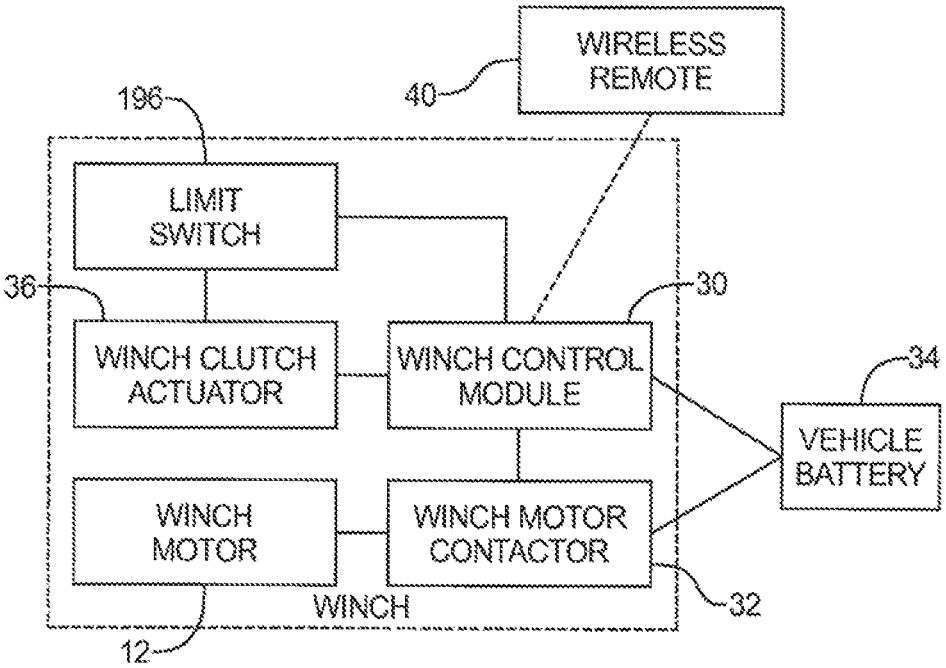
FIG. 2 is a schematic diagram of the controls of the winch according to the principles of the present disclosure.

With reference to FIG. 2, the control unit 26 of the winch 10 includes a winch control module 30 and a winch motor contactor 32 which are each connected to a vehicle battery 34. The winch control module 30 provides control signals to the winch motor contactor 32 which can supply current from the vehicle battery 34 to the winch motor 12. The winch control module 30 also can control a winch clutch actuator 36 that can be in the form of an electronic solenoid described in greater detail herein.

A wireless remote 40 can be provided for providing control signals to the winch control module 30 and for receiving feedback signals from the winch control module 30 regarding an operational status of the winch. The communication between the winch control module 30 and the wireless remote 40 can be performed by a pairing process that provides a two-way RF mesh network connection using a secured and encrypted wireless communication protocol.

Figure 3:
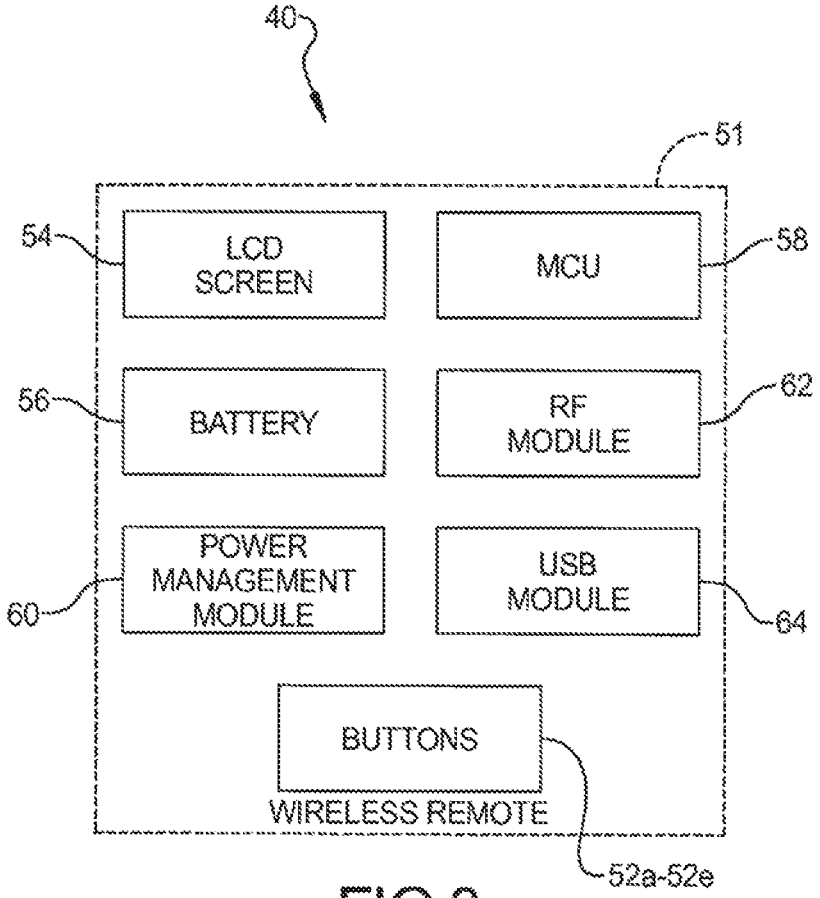
FIG. 3 is a schematic diagram of the components of the remote control unit.

The wireless remote 40 is a handheld device for controlling the winch and accessory functions. A schematic diagram of an exemplary handheld wireless remote device 40 is shown in FIG. 3. With reference to FIG. 3, the remote handheld device has a housing 51 with several buttons 52*a*-52*e* for control input and an LCD screen 54 for system feedback. The wireless remote 40 also includes a rechargeable battery 56, a microcontroller unit (MCU) 58, a power management module 60, an RF module 62, and a USB module 64. The buttons 52*a*-52*e* of the wireless remote 40 are arranged to accomplish the desired functions of the winch 10. The winch 10 will be controlled by two dedicated buttons 52*a*, 52*b* that control the power-in and power-out states of the winch which allow the cable to be pulled in or out, respectively. An additional button 52*c* is provided to control the winch clutch actuator and a fourth button 52*d* is provided to control the accessories. A fifth button 52*e* is provided to select the desired control mode and to access programmable functions.

The LCD screen 54 can provide visual feedback to the user. The feedback will include that status of control inputs such as winch power-in or power-out. Feedback may also include information such as vehicle battery voltage, winch motor current draw, winch motor temperature, winch load, and winch clutch position.

The winch control module 30 resides within the control unit 26 which can be on or near the winch 10. The winch control module 30 first functions to distribute power from the vehicle battery 34 to the winch motor 12 and clutch actuator. A second winch control module function is to establish a node in the two-way RF communication network with the wireless remote 40. As such, the winch control module 30 communicates with the wireless remote 40 to send and receive information. Information sent by the winch control module 30 may include winch and clutch operational status information. The information that is received by the winch control module 30 may be winch and clutch operational commands that are sent from the wireless remote 40.

A third winch control module function is to switch on or off the winch 10 and clutch actuator solenoid 36 electrical power according to the input commands received from the wireless remote 40 and the control programming. The control programming resides within a micro control unit 66 of the winch control module 30.

Figure 4:
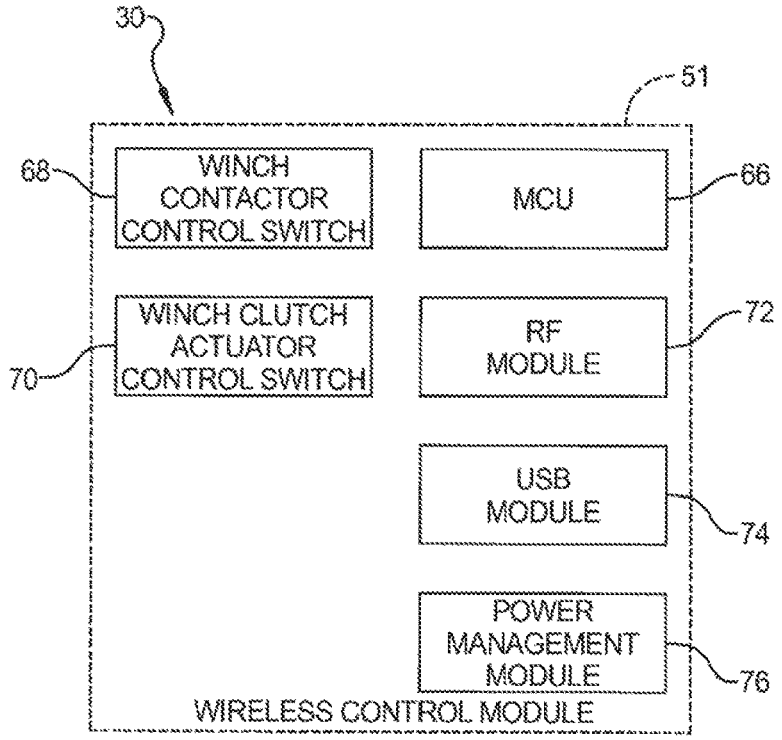
FIG. 4 is a schematic diagram of the components of the winch control module according to the principles of the present disclosure.

The winch control module 30, as illustrated in FIG. 4, can include the microcontroller unit 66 that contains the programmable data for controlling the operation of the winch 10 and clutch actuator 36. A winch contractor control switch 68 is provided for communication with the winch motor contractor 32. A winch clutch actuator control switch 70 is provided for communication with the winch clutch actuator 36. An RF module 72 can be provided for providing two-way RF communication between the winch control module 30 and the wireless remote 40. The winch control module 30 can also include a USB module 74 to allow the winch control module 30 to be connected to a computer or programming module for programming the MCU 66. A power management module 76 can be provided for managing the distribution of power from the vehicle battery to the winch 10.

Figure 5:
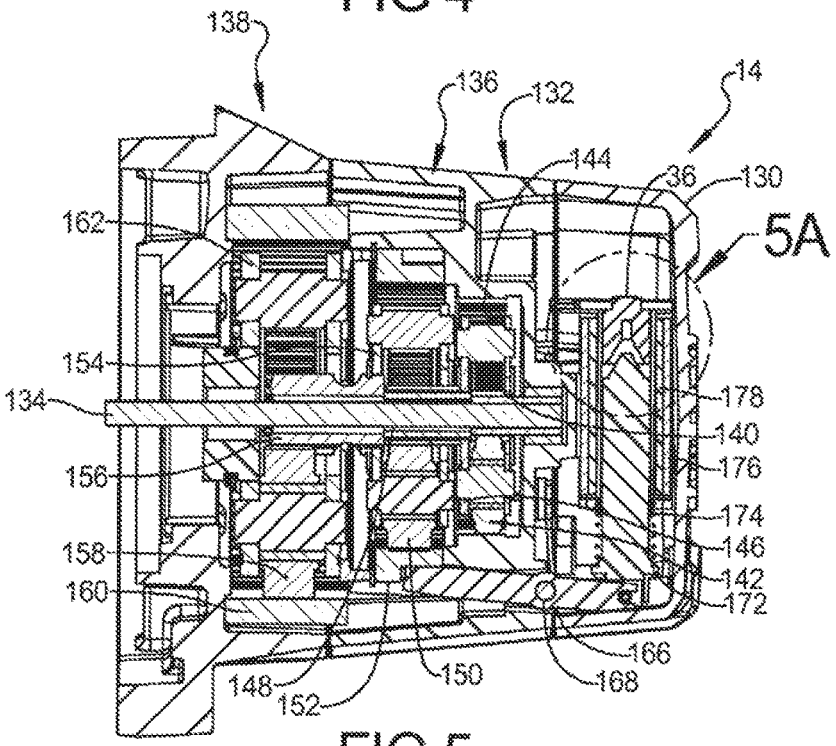
FIG. 5 is a longitudinal cross-sectional view of the gear reduction unit 14.

With reference to FIG. 5, the gear reduction unit 14 includes a housing 130 that is mounted to the second drum support 24. A first stage planetary gear set 132 is driven by a drive shaft 134 and delivers drive torque to a second stage planetary gear set 136. The second stage planetary gear set 136 provides torque to a third stage planetary gear set 138 which provides torque to the rotatable drum 16.

The first stage planetary gear set 132 includes a sun gear 140 that is drivingly connected to the drive shaft 134 and provides driving torque to a plurality of planetary gears 142 which are meshingly engaged with a ring gear 144 that is fixed within the housing 130. A planetary carrier 146 supports the planetary gears 142 and provides driving torque to a second sun gear 148 of the second stage planetary gear set 136.

The second sun gear 148 provides driving torque to a plurality of planetary gears 150 which are each in meshing engagement with a second stage ring gear 152. A second stage planetary carrier 154 supports the plurality of second stage planetary gears 150 and provides driving torque to a third sun gear 156 of the third stage planetary gear set 138.

The third stage sun gear 156 is in meshing engagement with a plurality of planetary gears 158 of the third stage planetary gear set 138. The third stage planetary gears 158 are in driving engagement with a third stage ring gear 160 which is fixed to housing 130. A third stage planetary carrier 162 supports the third stage planetary gears 158 and provides driving torque to the rotatable drum 16. The first stage ring gear 144 and the third stage ring gear 160 are each fixed non-rotationally relative to the housing 130.

The second stage ring gear 152 is operable in a first mode wherein the ring gear 152 is non-rotationally fixed within the housing 130 from normal driving operation of the drum 16. In a second operating mode, the second stage ring gear 152 is free to rotate relative to the housing 130 so that the gear reduction unit is in a free spool mode that allows the drum 16 to spool-out and rotate without being driven by the motor.

As illustrated in FIG. 5, a pivoting pawl 166 is provided with a pivot pin 168 so that the pivoting pawl 166 is able to engage and disengage the second stage ring gear 152. The pivoting pawl 166 is driven by the electromagnetic solenoid actuator 36 that includes a plunger 172 that is connected to a second end of the pawl 166 and is biased by a spring 174 toward a normal engaged position of the pawl 166.

The electromagnetic solenoid actuator 36 is a dual coil actuator including an outer pulldown coil 176 and an inner hold coil 178 that are each concentric the plunger 72. During operation, the pulldown coil 176 and gold coil 178 are both actuated to draw the plunger 172 to a disengaged position for disengaging the pawl 166 from the second stage ring gear 152. Once the plunger 172 is moved to the disengaged position, the pulldown coil 176 is no longer necessary to hold the plunger 172 in the disengaged position while the hold coil 178 is sufficient to hold the plunger 172 in the disengaged position. It is noted that the pulldown coil 176 is a relatively high power coil that can be actuated for a period of approximately 5 to 10 seconds in order to actuate the plunger 172 from the engaged to the disengaged position. The hold coil 178 is a relatively lower power coil than the pulldown coil 176 and can be maintained in an actuated state to allow free spooling from the rotatable drum 16 for an extended period of time.

Figure 5A:
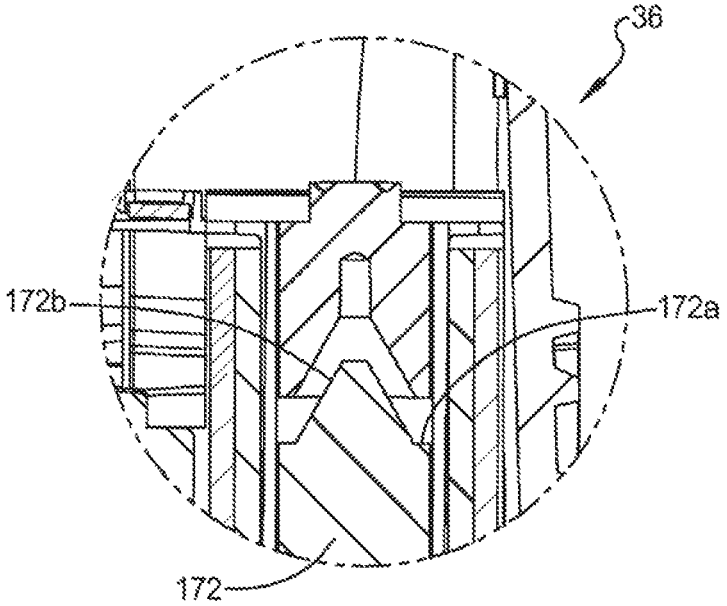
FIG. 5A is a detailed cross-sectional view of a stepped end of the plunger of the clutch actuator shown in FIG. 5.

With reference to FIG. 5A, a detailed view of the plunger 172 is shown including a cylindrical outer wall and stepped feature including a flat portion 172*a* which provide a high holding force when the gap is very small. This is useful in the hold mode when only the hold coil 178 is used. A cone portion 172*b* provides a high hold force when the gap is large. This is useful in maximizing the force of the solenoid 36 when both coils 176, 178 are energized during the pull down mode where the gap is large.

Figure 6:
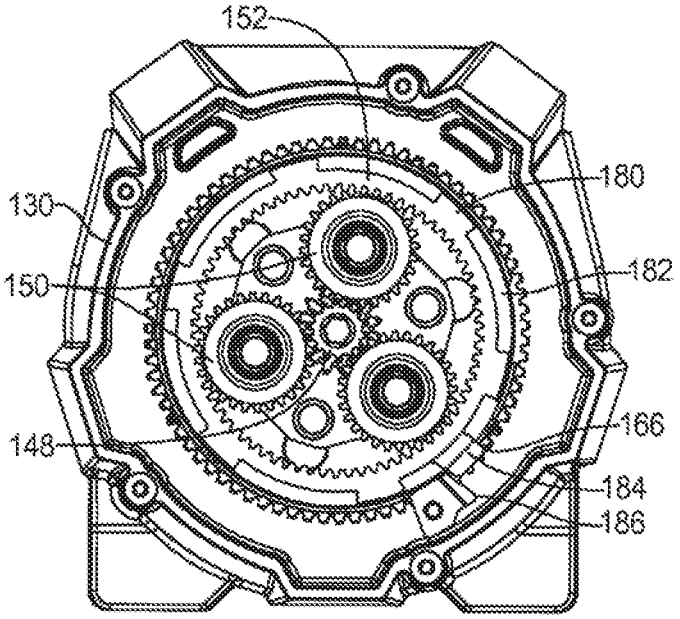
FIG. 6 is a cross-sectional view taken along line 6-6 of FIG. 1.

With reference to FIG. 6, the second stage ring gear 152 is shown including a plurality of ring gear clutch dogs 180 on the outer circumference of the ring gear 152 and including ring gear spaces 182 disposed between the ring gear clutch dogs 180.

As illustrated in FIG. 6 the pawl 166 includes a head 184 that engages a pawl stop 186 provided on the housing 130. The pawl head 184 and pawl stop 186 each have slightly angled opposing faces which impart a radially inward force component of the pawl 166 which tends to hold the pawl 166 in the engaged position. A high load on the winch 10 causes a high radial force tending to firmly hold the pawl 166 into the engaged position. In this condition, the solenoid actuator 36 has insufficient force to overcome the radial load, and the winch 10 will be prevented from shifting to the free spool mode while a load is being applied to the drum 16. In this way, high loads are prevented from being released either purposely or accidentally. If the winch load is low, the gap between the pawl head 184 and the pawl stop 186 is open. The opposing faces between the pawl head 184 and the second ring gear dog clutch 180 is straight and therefore provides very little resistance to the sliding motion. Therefore, in this condition, the force required to shift the pawl 166 to free-spool mode is low. Therefore, the force required of the solenoid actuator 36 is also low. This allows the size and cost of the solenoid 36 to be kept low. The pawl 166, the pawl stop 186, and the second ring gear 152 are each made of hardened steel to prevent wear of the mating parts during dynamic shifting between the engaged and free-spool modes.

Figure 7:
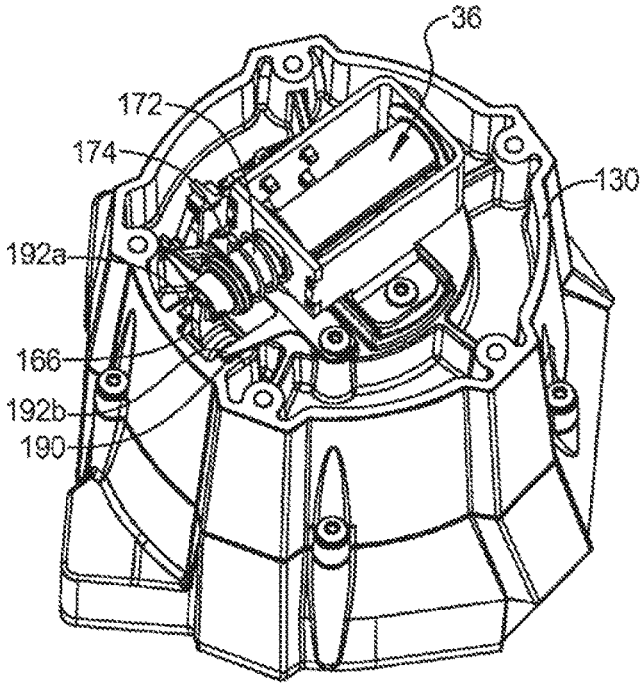
FIG. 7 is a first end perspective view of the gear reduction unit with the end cover removed showing the clutch actuator.
Figure 8:
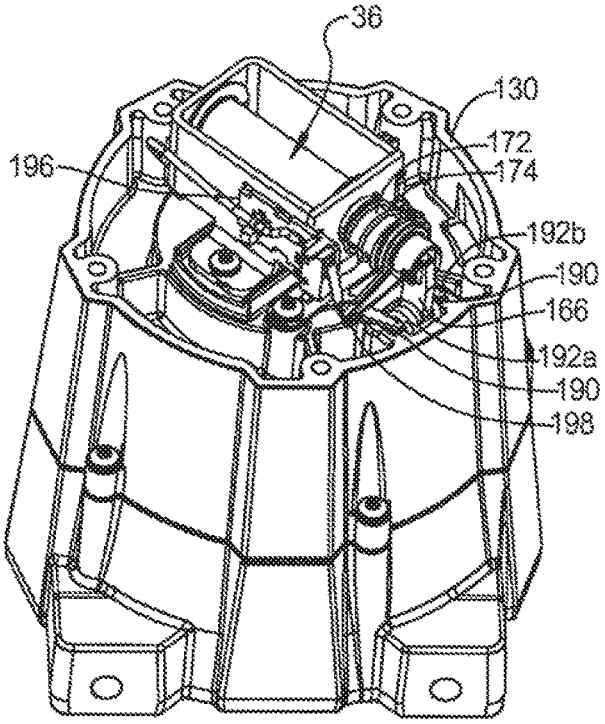
FIG. 8 is a perspective view similar to FIG. 7 taken from a different angle of the clutch actuator.

With reference to FIGS. 7 and 8, the plunger 172 of the solenoid actuator 36 is shown connected to the end of the pawl 166. The plunger 172 is oriented in a downwardly angled position so that gravity biases the plunger 172 toward the normally engaged position along with the spring 174. The pawl 166 is pivotally supported by the pivot pin 168 which is received in a pair of recessed slots 190 within the housing 130. A spring member including two spring fingers 192*a*, 192*b* are provided for holding each end of the pivot pin 168 within the slots 190. When the winch 10 is in the engaged mode and the clutch dog 180 is acting against the pawl head 184, the pawl head 184 is forced to move laterally. This force is reacted by the pawl pin 168. However, the pivot pin 168 which is held in the pockets 190 in the housing 130 by the finger springs 192*a*, 192*b* deflect under a certain load. When the finger springs 192*a*, 192*b* deflect, the pivot pin 168 can rock, and one end of the pin 168 will climb out of the pocket 190 against the force of the fingers springs 192*a*, 192*b*. This allows the pawl head 184 to move laterally against the pawl stop 186 wherein a high load on the winch 10 causes a high radial force between the pawl head 184 and pawl stop 186 to firmly hold the pawl 166 into its engaged position, as discussed in detail above.

With reference to FIG. 8, the solenoid actuator 36 is provided with a limit switch 196 that is in communication with the microcontroller unit 66 of the winch control module 30. The microcontroller unit 66 controls actuation of the motor 12 and the electromagnetic clutch actuator solenoid 36. When the limit switch 196 is engaged by the limit switch tripper 198 the limit switch 196 provides a signal to the microcontroller unit 66 to indicate that the clutch actuator 36 is in the free spool mode. The microcontroller unit 66 can transmit this information via wired or wireless communication to the remote control unit 40 that can include an indicator such as a colored or blinking light or other display such as LCD screen 54 to indicate to the user that the winch 10 is in the free spool mode.

It is further noted that the microcontroller unit 66 can provide control signals for disengaging the solenoid actuator 36 to allow the clutch to be reengaged. This can occur via a timed sequence wherein the microcontroller unit 66 only allows the clutch actuator 36 to remain in the disengaged position for a predetermined amount of time and then automatically deactivates the clutch actuator 36 to allow the clutch to be re-engaged. Furthermore, when the remote control unit 40 is operated in either a spool-in or spool-out direction, indicating that the user desires to operate the winch, the microcontroller unit 66 can deactivate the clutch actuator 36 to allow the clutch to be re-engaged when the operator initiates a spool-in or a spool-out operation.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A method, comprising:

operating a winch, where the winch comprises:

a rotatable drum;

a motor and a drive shaft drivingly connected to a first sun gear;

a gear train drivingly connecting the motor to the drum and including the first sun gear, a housing, a first plurality of planet gears coupled with the drum and engaged with the first sun gear, and a first ring gear engaged with the first plurality of planet gears;

a clutch adapted to be selectively disengaged with the first ring gear to allow the first ring gear to rotate relative to the housing and adapted to be selectively engaged with the first ring gear to fix a position of the ring gear relative to the housing;

a solenoid coupled to the clutch and adapted to move the clutch between an engaged position where the clutch is engaged with the first ring gear and a disengaged position where the clutch is disengaged from the first ring gear, where the solenoid includes a plunger, a first coil, and a second coil, where the second coil is a high power coil and the first coil is a lower power coil than the second coil; wherein the first and second coils are concentric with the plunger; and a controller in communication with the solenoid, where operating the winch includes, via the controller, operating the second coil and the first coil to move the clutch from the engaged position to the disengaged position and operating only the first coil to hold the clutch in the disengaged position.

2. The method of claim 1, wherein the solenoid includes a spring and further comprising biasing the plunger toward a direction that engages the clutch with a clutch dog of the first ring gear, wherein the clutch is in the engaged position when the clutch is engaged with the clutch dog.

3. The method of claim 2, wherein operating the second coil and the first coil to move the clutch from the engaged position to the disengaged position includes moving the plunger to a retracted position to disengage the clutch from the clutch dog and wherein the clutch is in the disengaged position when the clutch is disengaged from the clutch dog.

4. The method of claim 1, wherein each of the first coil and the second coil are concentric with the plunger, wherein operating the second coil and the first coil includes retracting the plunger into a retracted position, and wherein operating only the first coil to hold the clutch in the disengaged position includes holding the plunger in the retracted position by only actuating the first coil.

5. The method of claim 4, wherein operating the second coil and the first coil to move the clutch from the engaged position to the disengaged position and operating only the first coil to hold the clutch in the disengaged position includes maintaining the first coil in an actuated state for an extended period of time relative to the second coil.

6. The method of claim 1, wherein the drum is disposed between the gear train and the motor.

7. The method of claim 1, wherein the winch further comprises a wireless remote in communication with the controller, where the wireless remote is handheld and includes a plurality of buttons, and further comprising providing control signals to the controller from the wireless remote.

8. The method of claim 7, further comprising controlling the solenoid with a first button of the plurality of buttons and further comprising providing visual feedback via a screen of the wireless remote, where the visual feedback includes information including one or more of a winch motor current draw, winch motor temperature, winch load, and winch clutch position.

9. The method of claim 7, wherein the first ring gear includes a plurality of clutch dogs arranged on an outer circumference of the first ring gear and wherein when the clutch is in the engaged position, the clutch is engaged with one of the plurality of clutch dogs.

10. The method of claim 1, wherein the gear train includes three stages including a first stage planetary gear set driven by the drive shaft, a second stage planetary gear set driven by the first stage planetary gear set, and a third stage planetary gear set driven by the second stage planetary gear set, where the third stage planetary gear set provides torque to the drum.

11. The method of claim 10, wherein the first stage planetary gear set includes the first sun gear drivingly connected to the drive shaft, a first plurality of planet gears driven by the first sun gear, a second ring gear in meshing engagement with the first plurality of planet gears and fixed in the housing, and a first planetary carrier supporting the first plurality of planet gears.

12. The method of claim 11, wherein the second stage planetary gear set includes a second sun gear driven by the first planetary carrier, a second plurality of planet gears driven by the second sun gear, the first ring gear in meshing engagement with the second plurality of planet gears, and a second planetary carrier supporting the second plurality of planet gears.

13. The method of claim 12, wherein the third stage planetary gear set includes a third sun gear driven by the second planetary carrier, a third plurality of planet gears driven by the third sun gear, a third ring gear in meshing engagement with the third plurality of planet gears and fixed in the housing, and a third planetary carrier supporting the third plurality of planet gears, where the third planetary carrier provides driving torque to the drum.

14. A method for a winch, comprising:

via a controller of the winch:

receiving a first signal from a remote controller to disengage a clutch of a gear train of the winch and shift the winch into a free spool mode where a drum of the winch is allowed to free spool;

actuating both a first, high power coil and a second, lower power coil of an electro-magnetic solenoid clutch actuator of the winch to draw a plunger of the electro-magnetic solenoid clutch actuator to a retracted, disengaged position and subsequently move the clutch coupled to an end of the plunger out of engagement with a ring gear of the gear train; wherein the high power and lower power coils are concentric with the plunger; and once the plunger is moved into the disengaged position, only actuating the second coil to hold the plunger in the disengaged position and allow the ring gear to rotate relative to a housing of the gear train.

15. The method of claim 14, further comprising receiving a second signal from the remote controller to engage the clutch and, in response, deactivating the electro-magnetic solenoid clutch actuator, and moving the clutch into engagement with the ring gear so the ring gear is fixed relative to the housing, wherein the first coil and the second coil are actuated for a first period of time during the actuating both the first coil and second coil, and wherein the second coil is actuated for an extended, second period of time during the only actuating the second coil.

16. The method of claim 14, wherein the actuating both the first, high power coil and the second, lower power coil comprises distributing power from a vehicle battery to both the first, high power coil, and the second, lower power coil and wherein the only actuating the second coil comprises distributing power from a vehicle battery to only the second, lower power coil.

17. The method of claim 14, further comprising receiving a third signal from a limit switch of the electro-magnetic solenoid clutch actuator that indicates the electro-magnetic solenoid clutch actuator is in free spool mode where the ring gear rotates relative to the housing.

* * * * *